US007490035B2

(12) United States Patent
Fujishima et al.

(10) Patent No.: US 7,490,035 B2
(45) Date of Patent: Feb. 10, 2009

(54) PITCH SHIFTING APPARATUS

(75) Inventors: Takuya Fujishima, Hamamatsu (JP); Jordi Bonada, Barcelona (ES)

(73) Assignee: Yamaha Corporation, Hamamatsu-Shi (JP)

( * ) Notice: Subject to any disclaimer, the term of this patent is extended or adjusted under 35 U.S.C. 154(b) by 107 days.

(21) Appl. No.: 11/796,009

(22) Filed: Apr. 25, 2007

(65) Prior Publication Data

US 2007/0282602 A1 Dec. 6, 2007

Related U.S. Application Data

(63) Continuation of application No. PCT/JP2005/020156, filed on Oct. 27, 2005.

(30) Foreign Application Priority Data

Oct. 27, 2004 (JP) ..... 2004-311637

(51) Int. Cl.
*G10L 19/00* (2006.01)
*G10L 19/14* (2006.01)

(52) U.S. Cl. ..... 704/207

(58) Field of Classification Search ..... 704/207
See application file for complete search history.

(56) References Cited

U.S. PATENT DOCUMENTS

| | | | |
|---|---|---|---|
| 6,549,884 | B1 | 4/2003 | Laroche et al. |
| 2001/0051870 | A1 | 12/2001 | Okazaki et al. |
| 2003/0221542 | A1 | 12/2003 | Kenmochi et al. |

FOREIGN PATENT DOCUMENTS

| | | |
|---|---|---|
| JP | 01-211000 | 8/1989 |
| JP | 2000-259164 | 9/2000 |
| JP | 2001-356799 | 12/2001 |
| JP | 2002-215198 | 7/2002 |
| JP | 2003-255998 | 9/2003 |

OTHER PUBLICATIONS

Tsuyoshi Mekata et al., "Hochoki eno Oyo o Koryo Shita Formant Kyocho Hoho no Kento", The Acoustical Society of Japan (ASJ), Heisei 5 Nendo Shunki Kenkyu Happyokai Koen Ronbunshu, -I-, Mar. 17, 1993, pp. 285 and 286.

Jean Laroche et al., "New Phase-Vocoder Techniquest for Pitch-Shifting, Harmonizing and Other Exotic Effects", Proc. 1999 IEEE Workshop on Applications of Signal Processing to Audio and Acoustics, New Paltz, New York, Oct. 17-20, 1999, pp. 91-94.

*Primary Examiner*—Susan McFadden
(74) *Attorney, Agent, or Firm*—Morrison & Foerster LLP

(57) ABSTRACT

A pitch shifting apparatus detects peak spectra P1 and P2 from amplitude spectra of inputs sound. The pitch shifting apparatus compresses or expands an amplitude spectrum distribution AM1 in a first frequency region A1 including a first frequency f1 of the peak spectrum P1 using a pitch shift ratio which keeps its shape to obtain an amplitude spectrum distribution AM10 for a pitch-shifted first frequency region A10. The pitch shifting apparatus similarly compresses or expands an amplitude spectrum distribution AM2 adjacent to the peak spectrum P2 to obtain an amplitude spectrum distribution AM20. The pitch shifting apparatus performs pitch shifting by compressing or expanding amplitude spectra in an intermediate frequency region A3 between the peak spectra P1 and P2 at a given pitch shift ratio in response to the each amplitude spectrum.

17 Claims, 7 Drawing Sheets

PITCH SHIFTING APPARATUS

CROSS-REFERENCE TO RELATED APPLICATION

This application is a continuation of co-pending International Application No. PCT/JP2005/020156 filed on Oct. 27, 2005 and published under PCT Article 21(2) on May 4, 2006 as International Publication No. WO 2006/046761, the contents of which are incorporated herein by reference.

TECHNICAL FIELD

The present invention relates to a pitch shifting apparatus which shifts (or alters) a pitch of sound data.

BACKGROUND ART

Various pitch shifting apparatuses which alter (or shift) a pitch of sound data, such as voice data and musical sound data, have been known. One of these pitch shifting apparatuses transforms given sound data from data represented in the time domain (time domain representation) into data represented in the frequency domain (frequency domain representation), identifies a frequency region which includes a peak spectrum of an amplitude spectrum based on the transformed sound data and shifts only amplitude spectra within the identified frequency region by a given amount evenly (for example, see U.S. Pat. No. 6,549,884 (FIGS. 3 and 4A to 4C)).

Generally, sound data includes two or more peak spectra with different frequencies and naturally amplitude spectra exist between two of the peak spectra (i.e., within intermediate frequency region between frequencies corresponding to the two peak spectra). However, according to the conventional apparatus mentioned above, the amplitude spectra in the intermediate frequency region are neglected and not reflected in the pitch-shifted amplitude spectra. As a consequence, the problem arises that the pitch-shifted sound may contain unnatural sound.

DISCLOSURE OF THE INVENTION

Therefore, one of the objects of the present invention is to provide a pitch shifting apparatus which substantially compresses or expands amplitude spectra at uneven transformation ratios to prevent creation of sound data which generates unnatural sound, while retaining the characteristics of input sound (original sound).

In order to achieve the above object, a pitch shifting apparatus according to the present invention includes:

time-frequency transformation means for transforming input time domain representation sound data into frequency domain representation sound data;

pitch shifting means for generating pitch-shifted sound data by altering each pitch of amplitude spectra of the transformed frequency domain representation sound data;

frequency-time transformation means for transforming the pitch-shifted sound data from frequency domain representation sound data into time domain representation sound data; and output means for outputting the transformed time domain representation sound data.

In addition, the pitch shifting means is configured to select, based on the amplitude spectra of the transformed frequency domain representation sound data, at least one amplitude spectrum which expresses characteristics of the sound data as a selected amplitude spectrum, and to compress or expand the amplitude spectra of the sound data on a frequency axis while substantially keeping a shape of an amplitude spectrum distribution in a selected frequency region which is a frequency region including a selected frequency which is a frequency for the selected amplitude spectrum.

By means of the above configuration, pitch shifting of sound data is performed while the shape of an amplitude spectrum distribution AM1 in a selected frequency region A1 which adequately expresses the characteristics of the input sound (original sound) remains unchanged. Thus, the characteristics of the input sound are retained after pitch shift. Further, amplitude spectra in a region other than the selected frequency region A1 are not neglected but are reflected in amplitude spectra after pitch shift. Hence, it can be avoided that the pitch-shifted sound data includes sound data which generates unnatural sound.

One aspect of the pitch shifting apparatus according to the present invention includes:

time-frequency transformation means for transforming input time domain representation sound data into frequency domain representation sound data;

pitch shifting means for generating pitch-shifted sound data by compressing or expanding amplitude spectra of the transformed frequency domain representation sound data on a frequency axis;

frequency-time transformation means for transforming the pitch-shifted sound data from frequency domain representation sound data into time domain representation sound data; and output means for outputting the transformed time domain representation sound data.

In addition, the pitch shifting means is configured to select, based on amplitude spectra of the transformed frequency domain representation sound data, at least one amplitude spectrum which expresses characteristics of the sound data as a selected amplitude spectrum, shift the selected amplitude spectrum on the frequency axis so that the selected amplitude spectrum becomes an amplitude spectrum for a pitch-shifted selected frequency which is a frequency obtained by multiplying a selected frequency which is a frequency for the selected amplitude spectrum by a given pitch shift ratio k, compress or expand, on the frequency axis, each of amplitude spectra in a selected frequency region which is a given frequency region including the selected frequency so that each of the amplitude spectra in the selected frequency region becomes an amplitude spectrum for a frequency obtained by adding a value which is obtained by multiplying a result of subtraction of the selected frequency from a frequency for the each amplitude spectrum by a local shift ratio m closer to 1 than the pitch shift ratio k, to the pitch-shifted selected frequency; and compress or expand, on the frequency axis, each of amplitude spectra outside the selected frequency region so that each of the amplitude spectra outside the selected frequency region becomes an amplitude spectrum for a frequency obtained by multiplying "a frequency for the each amplitude spectrum" by "each pitch shift ratio depending on the each amplitude spectrum".

By means of the above configuration, the selected spectrum P1 adequately expressing the characteristics of the input sound is shifted on the frequency axis so that it becomes an amplitude spectrum P10 for a pitch-shifted selected frequency f10 (=k·f1) obtained by multiplying the frequency (selected frequency) f1 for the selected amplitude spectrum by the given pitch shift ratio k.

In addition, each amplitude spectrum in the selected frequency region A1 which is a region including the selected frequency f1 is compressed or expanded on the frequency axis so that the each amplitude spectrum in the selected frequency region A1 becomes an amplitude spectrum for a frequency (=m·(fn−f1)+k·f1) obtained by adding a value (=m·(fn−f1)) which is obtained by multiplying a result (=fn−f1) of subtraction of the selected frequency f1 from a frequency fn for the each amplitude spectrum by a local shift ratio m closer to 1 than the pitch shift ratio k, to the pitch-shifted selected frequency f10.

As a result, since the spectrum distribution AM1 in the selected frequency region A1 which expresses the characteristics of the input sound turns into pitch-shifted data while keeping its distribution shape, the characteristics of the input sound are retained after pitch shift.

On the other hand, each amplitude spectrum outside the selected frequency region A1 is compressed or expanded on the frequency axis so that it becomes an amplitude spectrum for the frequency obtained by multiplying a frequency fn for the each amplitude spectrum by an appropriate pitch shift ratio depending on (varying in response to) the each amplitude spectrum.

By means of the above configuration, the amplitude spectra outside the selected frequency region A1 are not neglected but are reflected in amplitude spectra after pitch shift. Hence, it is avoided that the pitch-shifted sound data includes sound data which generates unnatural sound.

Another aspect of the pitch shifting apparatus according to the present invention includes, similarly to the above pitch shifting apparatuses, time-frequency transformation means, pitch shifting means, frequency-time transformation means and output means.

In addition, according to the pitch shifting means of this pitch shifting apparatus, at least two peak spectra, one of which is a first peak spectrum P1 and the other one of which is a second peak spectrum P2 having a second frequency f2 higher than a first frequency f1 which is a frequency for the first peak spectrum P1, are selected among the amplitude spectra of the transformed frequency domain representation sound data.

Further, the first peak spectrum P1 is shifted on the frequency axis so that it becomes an amplitude spectrum P10 for a pitch-shifted first frequency f10 (=k·f1), which is a frequency obtained by multiplying the first frequency f1 by a given pitch shift ratio k.

Furthermore, each amplitude spectrum in a first frequency region A1 which is a frequency region including the first frequency f1 is compressed or expanded on the frequency axis so that it becomes an amplitude spectrum for a frequency (=m·(fn−f1)+k·f1) obtained by adding a value (=m·(fn−f1)) which is obtained by multiplying the result (=fn−f1) of subtraction of the first frequency f1 from a frequency fn for the each amplitude spectrum by a local shift ratio m closer to 1 than the pitch shift ratio k, to the pitch-shifted first frequency f10.

Similarly, the second peak spectrum P2 is shifted on the frequency axis so that it becomes an amplitude spectrum P20 for a pitch-shifted second frequency f20 (=k·f2) which is a frequency obtained by multiplying the second frequency f2 by the given pitch shift ratio k.

Furthermore, each amplitude spectrum in a second frequency region A2 which is a frequency region including the second frequency f2 is compressed or expanded on the frequency axis so that it becomes an amplitude spectrum for a frequency (=m·(fn−f2)+k·f2) obtained by adding a value (=m·(fn−f2)) which is obtained by multiplying the result (=fn−f2) of subtraction of the second frequency f2 from a frequency fn for the each amplitude spectrum by the local shift ratio m, to the pitch-shifted second frequency f20.

As a result, the spectrum distribution AM1 adjacent to the first peak spectrum P1 and the spectrum distribution AM2 adjacent to the second peak spectrum P2, both of which express the characteristics of the input sound, are turned into pitch-shifted data while keeping their distribution shapes. Thus, the characteristics of the input sound are retained after pitch shift.

On the other hand, each amplitude spectrum in an intermediate frequency region A3 between the first frequency region A1 and the second frequency region A2 is compressed or expanded on the frequency axis so that it becomes an amplitude spectrum for a frequency obtained by multiplying a frequency fn for the each amplitude spectrum by an appropriate pitch shift ratio depending on (varying in response to) the each amplitude spectrum.

Accordingly, the amplitude spectra in the intermediate frequency region A3 are not neglected but are reflected in amplitude spectra after pitch shift. Hence, it is avoided that the pitch-shifted sound data includes sound data which generates unnatural sound.

In this case, it is preferable that the pitch shifting means be configured in such a manner that:

assuming a graph where a horizontal axis or X axis represents frequency before pitch shift and a vertical axis or Y axis represents frequency after pitch shift, and also assuming that k denotes the given pitch shift ratio, m denotes the local shift ratio, a1 and a2 denote given constants, f1 denotes the first frequency, f2 denotes the second frequency, f1max denotes maximum frequency of the first frequency region and f2min denotes minimum frequency of the second frequency region, compress or expand each amplitude spectrum in the first frequency region on the frequency axis in accordance with function Y=m·X+a1;

compress or expand each amplitude spectrum in the second frequency region on the frequency axis in accordance with function Y=m·X+a2;

where k satisfies a relation of k=((m·f2+a2)−(m·f1+a1))/(f2−f1); and further, compress or expand each amplitude spectrum in the intermediate frequency region on the frequency axis in accordance with a given function Y=Tf(X) connecting a point (f1max, f1max+a1) with a point (f2min, f2min+a2) in the intermediate frequency region. The function Tf(X) may be a straight line function or a curved line function.

It is also preferable that the pitch shifting means be configured in such a manner that, when compressing or expanding each amplitude spectrum in the intermediate frequency region on the frequency axis, make the each amplitude spectrum a value smaller than the each amplitude spectrum prior to the compression or the expansion.

With this configuration, the amplitude spectra other than those which express the characteristics of input sound become smaller. As a consequence, the pitch-shifted sound data which reflects the characteristics of the input sound is obtained.

In addition, the pitch shifting means may be configured to make an amplitude spectrum in a region in which a frequency after the compression or the expansion is above a given high threshold, substantially 0 or may be configured to make an amplitude spectrum in a region in which a frequency after the compression or the expansion is below a given low threshold, substantially 0.

By means of the above configurations, even if, by the compression or the expansion on the frequency axis, an amplitude spectrum for a high frequency or low frequency which cannot occur in a normal musical performance should occur, the amplitude spectrum for such a frequency is removed. Thus sound data which can produce good quality sound can be generated.

BEST MODE FOR CARRYING OUT THE INVENTION

Figure 1:
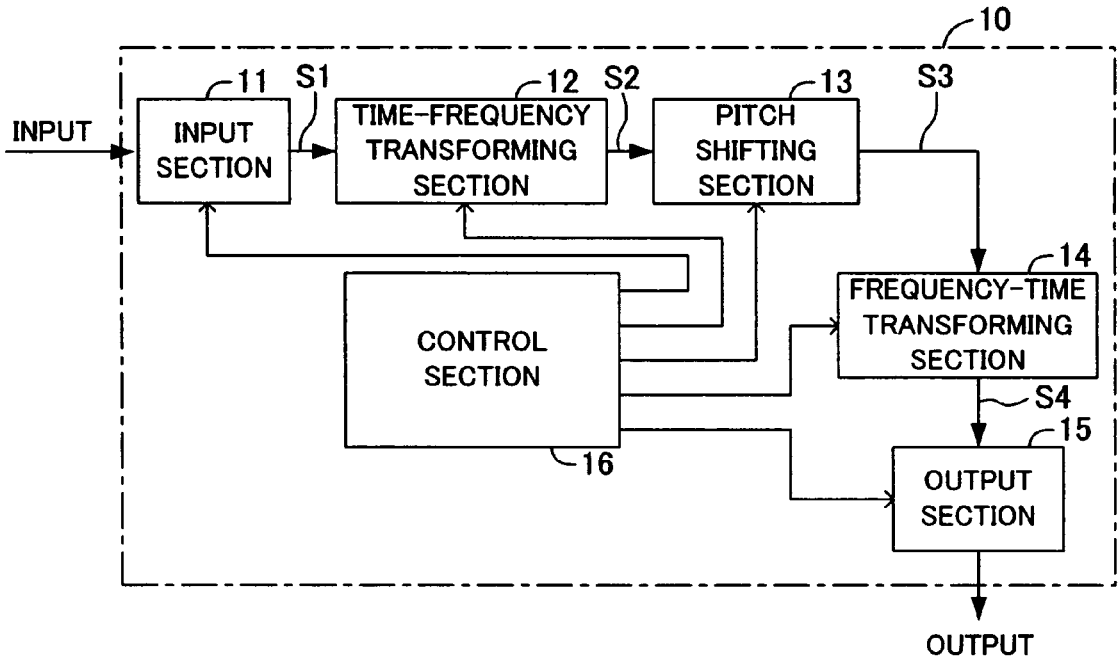
FIG. 1 is a block diagram showing a pitch shifting apparatus according to an embodiment of the present invention.

Next, a pitch shifting apparatus according to an embodiment of the present invention will be described referring to the drawings.

(Constitution)

As shown in FIG. 1, the present pitch shifting apparatus 10 includes an input section 11, a time-frequency transforming section 12, a pitch shifting section (pitch processing section) 13, a frequency-time transforming section 14, an output section 15, and a control section 16. In a practical sense, functions of these sections are realized (performed) by an execution of given programs executed by a CPU (not shown) of the pitch shifting apparatus 10 which is a computer including the control section 16.

The input section 11, which includes an A/D converter which converts an input analog signal into a digital signal and outputs it, is configured to convert an input analog sound signal into a digital signal (data) S1. The data thus obtained is sound data represented in the time domain (time domain representation sound data) S1. A signal received by the input section 11 may be inputted into the input section 11 through a microphone or directly from another device. If a digital signal is inputted into the input section 11 from another device, the input section 11 converts the input digital signal into a digital signal suitable for the pitch shifting apparatus 10.

The time-frequency transforming section 12, which is connected with the input section 11, is configured to receive the sound data S1 from the input section 11. The time-frequency transforming section 12 transforms the sound data S1 from the time domain representation sound data into a frequency domain representation sound data. More specifically, the time-frequency transforming section 12 divides the input sound data S1 represented in the time domain into a series of time frames and carries out frequency analysis of each frame by FFT (Fast Fourier Transform), etc. to obtain frequency spectra (amplitude spectra and phase spectra). The frequency spectra are data S2 represented in the frequency domain (frequency domain representation sound data).

The pitch shifting section 13, which is connected with the time-frequency transforming section 12, is configured to receive the data S2 from the time-frequency transforming section 12. The pitch shifting section 13 performs pitch shifting (pitch shift processing) on the data S2, which will be described in detail later, to generate pitch-shifted data S3. The data S3 is frame data (amplitude spectrum data and phase spectrum data) in the frequency domain. The pitch shifting section 13 is configured to be capable of altering parameters necessary for the pitch shifting such as a pitch shift ratio (k), which will be described later, in accordance with signals entered from an input device (not shown).

The frequency-time transforming section 14, which is connected with the pitch shifting section 13, is configured to receive the data S3 from the pitch shifting section 13. The frequency-time transforming section 14 performs inverse FFT on the data S3 to transform the data S3 represented in the frequency domain into data S4 represented in the time domain and then outputs the resulting data S4.

The output section 15 is configured to include a D/A converter and is connected with the frequency-time transforming section 14. The output section 15 D/A-converts the data S4 received from the frequency-time transforming section 14 at a given timing and outputs the resulting analog signal as sound. It should be noted that the output section 15 may be configured to output the analog signal obtained by the conversion as an electric signal, or output the data S4 as digital data, or store the data S4 in another storage means.

The control section 16, which is a well known computer including a CPU, a ROM and a RAM, is configured to perform various processes for the above sections and also give such devices as the A/D converter of the input section 11 and the D/A converter of the output section 15 instructions to let them carry out their functions including the A/D conversion and the D/A conversion at required times.

Note that, except for the processes relating to the present application which the pitch shifting section 13 performs, details of the above sections are described, for instance, in Japanese Laid Open Publication No. 2003-255998, as previously filed by the present applicant.

(Summary of the Pitch Shifting Processes)

Figure 2:
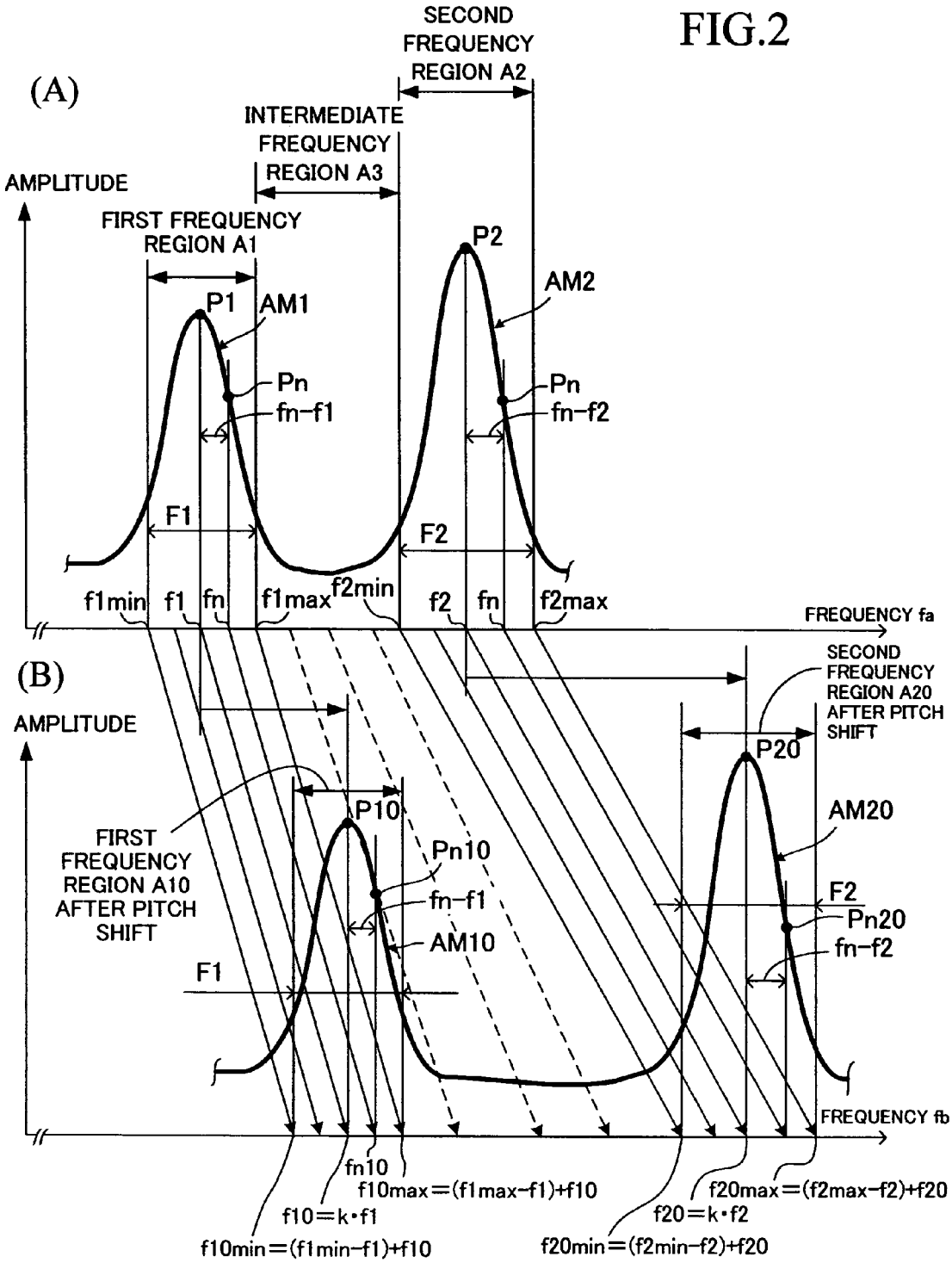
FIG. 2 is a graph giving an outline of the pitch shifting method by the pitch shifting apparatus shown in FIG. 1.
Figure 3:
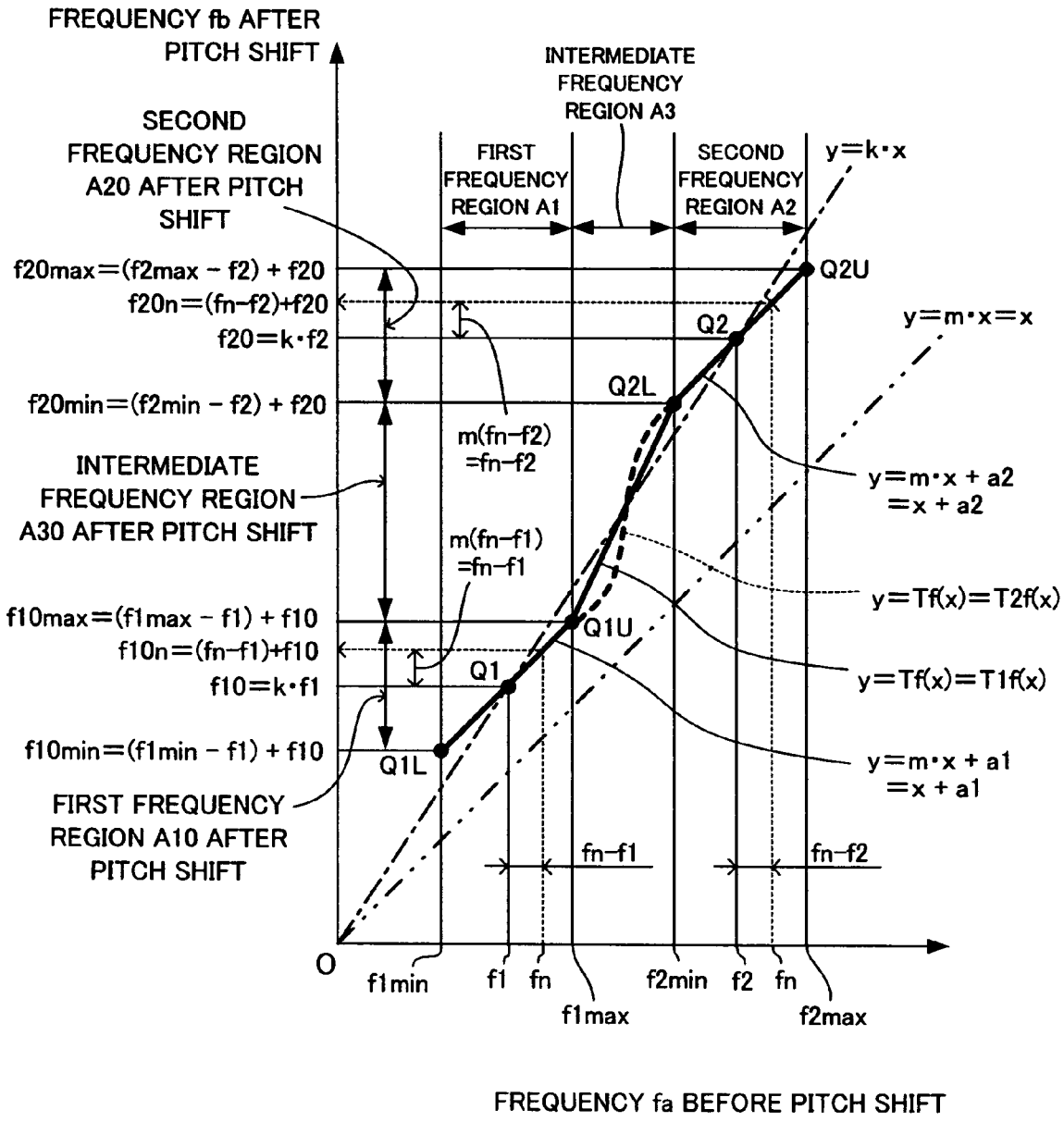
FIG. 3 is a graph giving an outline of the pitch shifting method by the pitch shifting apparatus shown in FIG. 1.

Next, the pitch shifting performed by the pitch shifting section 13 is generally described referring to FIGS. 2 and 3. It should be noted that all of frequencies in the drawings are expressed by linear plots, the frequencies will be referred in the explanation given below. FIGS. 2 and 3 show an example of pitch shift to a higher note.

(A) of FIG. 2 is a graph showing amplitude spectra of a frame before pitch shift (amplitude spectra included in the above data S2). In this example, a local peak (first peak spectrum) P1 of an amplitude spectrum exists at a first frequency f1 and a local peak (second peak spectrum) P2 of another spectrum exists at a second frequency f2 which is larger than the first frequency. First, the pitch shifting section 13 detects the local peaks based on the data S2. The local peaks are detected by a method of detecting a peak having the largest amplitude value among plural adjacent peaks or a similar method.

With the above process, at least one amplitude spectrum (two amplitude spectra in this case) expressing the characteristics of the sound data is selected as a selected amplitude spectrum (first peak spectrum P1 and second peak spectrum P2), based on the amplitude spectra of the sound data transformed into a frequency domain representation.

Next, the pitch shifting section 13 identifies (specifies, determines) a certain frequency region (spectra distribution region) which includes frequencies for detected local peaks (first frequency f1 and second frequency f2 in this case). In the example of (A) of FIG. 2, the pitch shifting section 13 identifies a certain frequency region which includes the first frequency f1 for the first peak spectrum P1 as a first frequency region A1. Such identification of a frequency region can be made in various ways. For example, the pitch shifting section 13 obtains a frequency (=f1+Δf) by adding frequency Δf which is obtained by multiplying a half of the difference between the first frequency f1 and second frequency f2 by a positive value of 1 or less, to the first frequency f1, as a maximum frequency f1max of the first frequency region A1. Similarly, the pitch shifting section 13 obtains a frequency (=f1−Δf) by subtracting the frequency Δf from the first frequency f1, as a minimum frequency f1min of the first frequency region A1. The amplitude spectra for frequencies in the first frequency region A1 have an amplitude spectrum distribution AM1.

Similarly, the pitch shifting section 13 identifies a certain frequency region which includes the second frequency f2 for the second peak spectrum P2 as a second frequency region A2. A maximum frequency and a minimum frequency in the second frequency region A2 are f2max (for example, f2max=f2+Δf) and f2min (for example, f2min=f2−Δf), respectively. The amplitude spectra for frequencies in the second frequency region A2 have an amplitude spectrum distribution AM2.

With the above processes, amplitude spectra in the selected frequency region (the first frequency region A1 or the second frequency region A2), which is a frequency region which includes the selected frequency (the first frequency f1 or the second frequency f2), are determined.

Then, the pitch shifting section 13 performs the pitch shifting by compressing or expanding the amplitude spectra on the frequency axis as follows. In the examples shown in FIGS. 2 and 3, the amplitude spectra are expanded on the frequency axis. In other words, the pitch shift ratio k is larger than "1".

(A) The pitch shifting section 13 shifts the first peak spectrum P1 on the frequency axis so that the first peak spectrum P1 becomes an amplitude spectrum for a pitch-shifted first frequency (a first frequency after pitch shift) f10 (=k·f1), the pitch-shifted first frequency f10 is a frequency obtained by multiplying the first frequency f1 by the given pitch shift ratio k. The magnitude of the first peak spectrum after pitch shift (the pitch-shifted first peak spectrum) P10 thus obtained is equal to the magnitude of the first peak spectrum P1.

(B) The pitch shifting section 13 compresses or expands each of amplitude spectra in the first frequency region A1 on the frequency axis so that each of the amplitude spectra Pn in the first frequency region A1 becomes an amplitude spectrum for a frequency (=m·(fn−f1)+k·f1) obtained by adding a value (=m·(fn−f1)) which is obtained by multiplying the result of subtraction (=fn−f1) of the first frequency f1 from the frequency fn for the each amplitude spectrum Pn by a local shift ratio m which is closer to 1 than the pitch shift ratio k, to the above pitch-shifted first frequency f10 (=k·f1). In this example, the local shift ratio m is set to 1.

With the above process, only the pitch of the amplitude spectrum distribution AM1 in the first frequency region A1 is shifted while its shape (distribution condition) remains unchanged so that the amplitude spectrum distribution AM1 in the first frequency region A1 turns into an amplitude spectrum distribution AM10 in the first frequency region after pitch shift A10.

(C) Similarly, the pitch shifting section 13 shifts the second peak spectrum P2 on the frequency axis so that the second peak spectrum P2 becomes an amplitude spectrum for the pitch-shifted second frequency (the second frequency after pitch shift) f20 (=k·f2) which is obtained by multiplying the second frequency f2 by the pitch shift ratio k. The magnitude of the second peak spectrum after pitch shift (the pitch-shifted second peak spectrum) P20 thus obtained is equal to the magnitude of the second peak spectrum P2.

(D) Furthermore, the pitch shifting section 13 compresses or expands each of amplitude spectra in the second frequency region A2 on the frequency axis so that each of the amplitude spectra Pn in the second frequency region A2 becomes an amplitude spectrum for a frequency (=m·(fn−f2)+k·f2) obtained by adding a value (=m·(fn−f2)) which is obtained by multiplying the result of subtraction (=fn−f2) of the second frequency f2 from the frequency fn for the each amplitude spectrum Pn by the local shift ratio m which is closer to 1 than the pitch shift ratio k, to the above pitch-shifted second frequency f20 (=k·f2).

With the above process, only the pitch of the amplitude spectrum distribution AM2 in the second frequency region A2 is shifted while its shape (distribution condition) remains unchanged so that the amplitude spectrum distribution AM2 in the second frequency region A2 turns into an amplitude spectrum distribution AM20 in the second frequency region after pitch shift A20.

(E) Furthermore, the pitch shifting section 13 performs pitch shifting on amplitude spectra in an intermediate frequency region A3 between the first frequency region A1 and second frequency region A2. This pitch shifting will be explained referring to FIG. 3.

FIG. 3 is a graph in which the horizontal axis or X axis represents frequency fa before the pitch shift and the vertical axis or Y axis represents frequency fb after the pitch shift. In the explanation given below, Q1 denotes a point on the transformation function Tf(x) for the first frequency f1 and Q2 denotes a point on the transformation function Tf(x) for the second frequency f2. Likewise, Q1U denotes a point on the transformation function Tf(x) for the maximum frequency f1max of the first frequency region A1 and Q2L denotes a point on the transformation function Tf(x) for the minimum frequency f2min of the second frequency region A2.

In this case, for the first frequency region A1, the frequency after pitch shift fb(=y, pitch-shifted frequency) is determined by substituting the frequency before pitch shift fa as variable x into transformation function Tf(x) expressed by Equation (1) below.

$$y=Tf(x)=m\cdot x+a1=x+a1=x+\Delta S1 \quad (1)$$

Similarly, for the second frequency region A2, the frequency after pitch shift fb (=y) is determined by substituting the frequency before pitch shift fa as variable x into transformation function Tf(x) expressed by Equation (2) below.

$$y=Tf(x)=m\cdot x+a2=x+a2=x+\Delta S2 \quad (2)$$

On the other hand, the pitch shifting section 13 performs pitch shifting on the intermediate frequency region A3 in accordance with transformation function Tf(x)=T1f(x) which connects points Q1U with Q2L by a straight line. In other words, since the coordinates of point Q1U are (f1max, f10max)=(f1max, f1max+a1) and the coordinates of point Q2L are (f2min, f2Omin)=(f2min, f2min+a2), the transformation function Tf(x)=T1f(x) for the intermediate frequency region A3 is expressed by Equation (3) below:

$$y = Tf(x) \tag{3}$$
$$= \frac{f2\min - f1\max + a2 - a1}{f2\min - f1\max} \cdot x + \frac{a1 \cdot f2\min - a2 \cdot f1\max}{f2\min - f1\max}$$

The pitch shifting section 13 performs pitch shifting on the amplitude spectrum for the frequency before pitch shift fa in accordance with Equation (3) so that the amplitude spectrum for the frequency before pitch shift fa becomes an amplitude spectrum for the frequency after pitch shift fb=Tf(fa). In this case, the gradient of the straight line connecting the origin O with a point (fa, Tf(fa)) which satisfies Equation (3) is a pitch shift ratio Pfa for the amplitude spectrum for frequency fa. In other words, the pitch shift ratio Pfa for the intermediate frequency region A3 is uniquely determined for the each amplitude spectrum depending on (varying in response to) the frequency of the amplitude spectrum.

Since the pitch shift ratio k is the gradient of the straight line connecting points Q1 with Q2, it satisfies a relation with the local shift ratio m, as expressed by Equation (4) below:

$$k=((m \cdot f2+a2)-(m \cdot f1+a1))/(f2-f1) \tag{4}$$

In other words, the pitch shifting section 13 does not compress (k<1) or expands (k>1) sound data before pitch shift on the frequency axis at pitch shift ratio k evenly. Instead, the pitch shifting section 13 performs compression or expansion in such a way that sound data adjacent to the peak spectrum P1 and peak spectrum P2 (sound data in the first frequency region A1 and sound data in the second frequency region A2) are not compressed nor expanded substantially and only its pitch is altered by an amount depending on the pitch shift ratio k. In addition, the pitch shifting section 13 compresses or expands the sound data in the intermediate frequency region A3 on the frequency axis at a shift ratio which is different from the pitch shift ratio k but alters depending on each of the amplitude spectrum (frequency for each amplitude spectrum).

As described, the pitch shifting section 13 performs the pitch shifting by nonlinearly compressing or nonlinearly expanding amplitude spectra with respect to frequencies. As a consequence, the spectrum distribution AM1 in the first frequency region A1 and the spectrum distribution AM2 in the second frequency region A2, which well express the characteristics of the input sound (original sound), are pitch shifted while keeping their distributions. Hence, the sound produced based on the pitch-shifted sound data retains the characteristics of the input sound. Besides, the amplitude spectra in the intermediate frequency region A3 are not neglected (cut off), but are reflected in the amplitude spectra after pitch shift (the pitch-shifted amplitude spectra). Hence, the sound produced based on the pitch-shifted sound data is less likely to give a sense of unnaturalness.

It should be noted that the transformation function Tf(x) for the intermediate frequency region A3 may be one of various functions. For example, the transformation function Tf(x) may be such a function that the gradient gradually changes from the local shift ratio m (increases when k>1 or decreases when k<1) in the zone from the point Q1U to the point Q2L and then again becomes closer to the local shift ratio m, as indicated by dotted curve T2f(x) in FIG. 3.

Furthermore, the transformation function Tf(x) for the first frequency region A1 and the second frequency region A2 may be any one of functions that is capable of pitch-shifting in each frequency region while keeping the spectrum distribution in each frequency region substantially unchanged. Therefore, for example, the local shift ratio m need not always be constant and the transformation function Tf(x) may be an expression of degree n or any functions determined accordingly. It should also be noted that the pitch shifting section 13 modifies phase spectra in response to the pitch shifting of amplitude spectra.

(Actual Pitch Shifting Operation)

Figure 4:
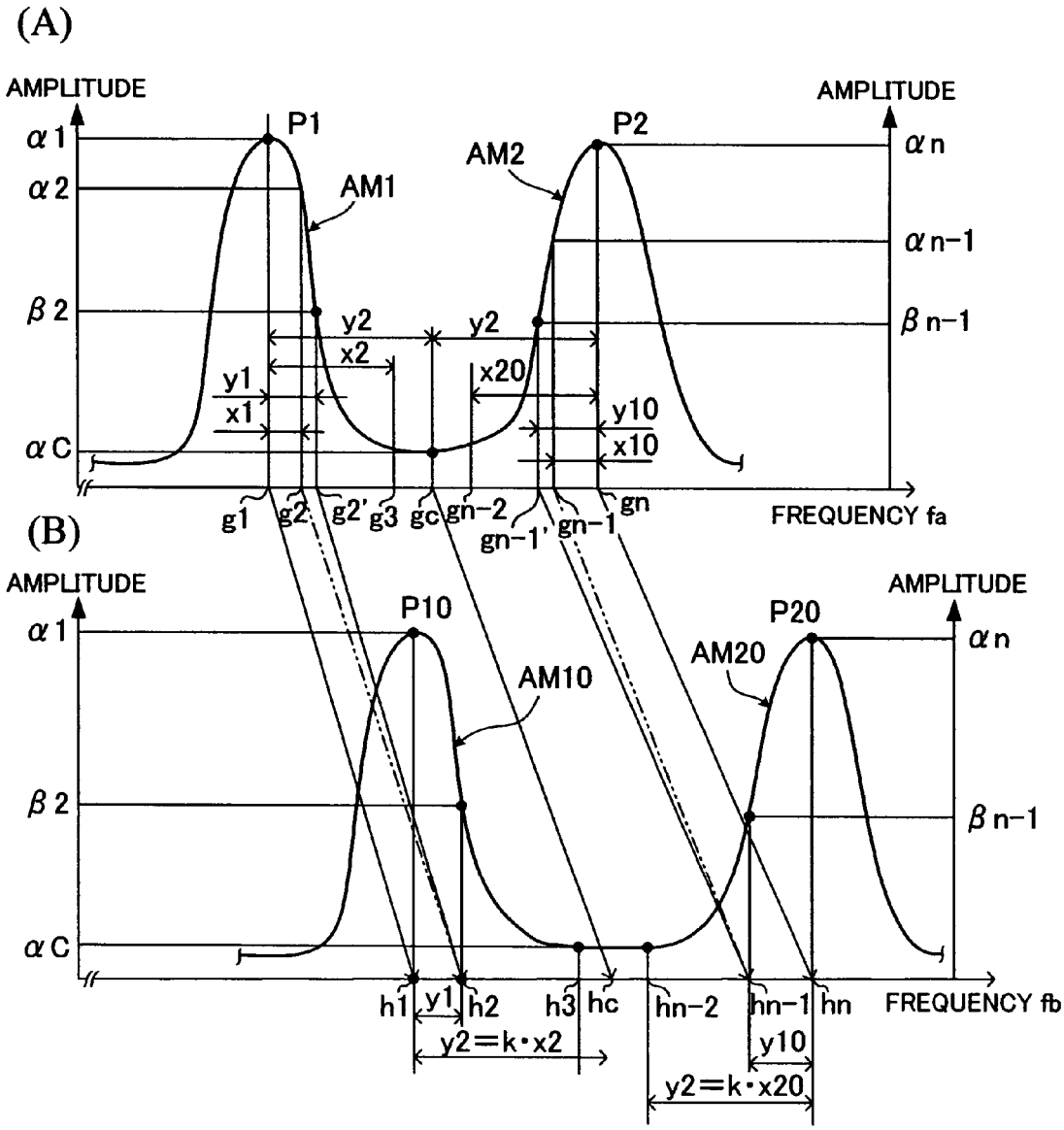
FIG. 4 is a graph illustrating a concrete example of the pitch shifting method by the pitch shifting apparatus shown in FIG. 1.
Figure 5:
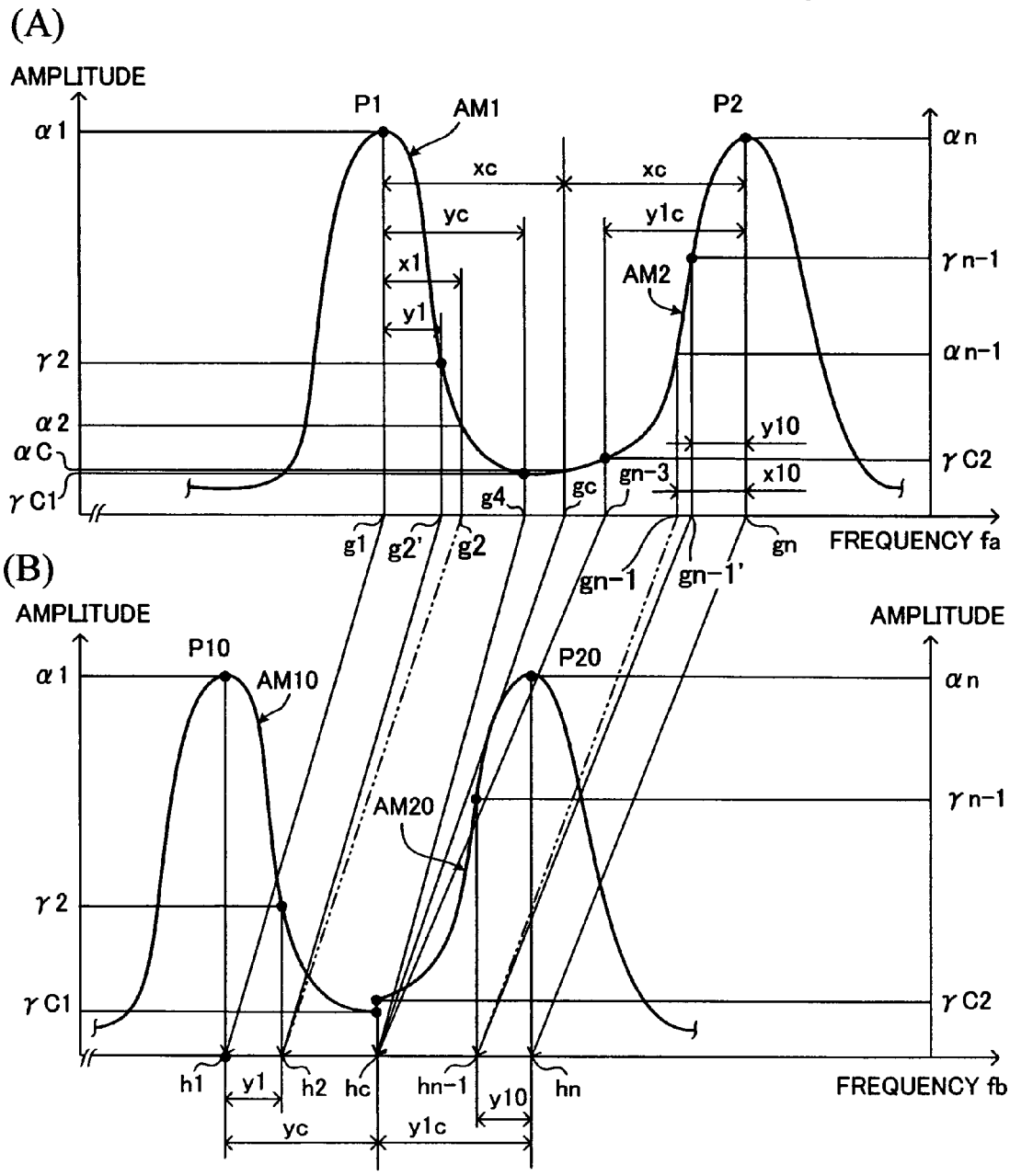
FIG. 5 is graphs illustrating a concrete example of the pitch shifting method by the pitch shifting apparatus shown in FIG. 1.

Next, an example of actual operation of the pitch shifting section 13 will be explained referring to FIGS. 4 and 5. FIG. 4 show an example of pitch shifting to expand sound data S2, in which (A) shows amplitude spectra before pitch shift and (B) shows amplitude spectra after pitch shift (pitch-shifted amplitude spectra). FIG. 5 show an example of pitch shifting to compress sound data S2, in which (A) shows amplitude spectra before pitch shift and (B) shows amplitude spectra after pitch shift (pitch-shifted amplitude spectra). Here, the frequency of the first peak spectrum P1 is first frequency g1 and the frequency of the second peak spectrum P2 is second frequency gn. The middle frequency between the first frequency g1 and the second frequency gn is a middle frequency gc (gc=(g1+gn)/2) and the difference from the first frequency g1 to the middle frequency gc is expressed by y2 or xc.

1. Expansion of Input Sound Data

First, in the case of pitch shifting for expansion of input sound data, the pitch shifting section 13 shifts the first peak spectrum P1 for the first frequency g1 as it is so that it becomes the spectrum (peak spectrum P10) for the pitch-shifted first frequency h1, as shown in FIG. 4. As mentioned previously, h1=k·g1 where k is larger than 1.

Next, the pitch shifting section 13 adopts, as the amplitude spectrum for the frequency after pitch shift h2 (=k·g2) corresponding to the frequency g2 which is larger than the first frequency g1 by x1, an amplitude spectrum value β2 of sound data before pitch shift corresponding to a frequency g2' larger than the first frequency g1 by y1, instead of an amplitude spectrum value α2 of sound data before pitch shift for the frequency g2. In this case, y1 is a value obtained by multiplying x1 by the pitch shift ratio k (i.e., y1=k·x1) where y1 is larger than x1.

The pitch shifting section 13 gradually increases frequency x1 from the first frequency g1 to perform pitch shifting on amplitude spectra before pitch shift, sequentially. As a consequence, when the frequency of an amplitude spectrum as the object of pitch shifting becomes larger than a frequency g3 (g3=g1+x2), the frequency difference x1 from the first frequency g1 becomes larger than a difference x2. The x2 is a value which becomes y2 (difference between the first frequency g1 and the middle frequency gc) when multiplied by the pitch shift ratio k (x2·k=y2). For the region in which the frequency difference x1 from the first frequency g1 is larger than x2 and smaller than y2 (i.e. for frequencies from g3 to gc), the pitch shifting section 13 sets the amplitude spectra after pitch shift to αC which is an amplitude spectrum value for the middle frequency gc before pitch shift.

Similarly, the pitch shifting section 13 shifts the second peak spectrum P2 for the second frequency gn as it is so that it becomes the spectrum (peak spectrum P20) for the second frequency after pitch shift hn. As mentioned previously, hn=k·gn.

Next, the pitch shifting section 13 adopts, as the amplitude spectrum for the frequency after pitch shift hn−1 (=k·(gn−1)) corresponding to the frequency gn−1 which is smaller than the second frequency gn by x10, an amplitude spectrum value βn−1 of sound data before pitch shift corresponding to a frequency gn−1' smaller than the second frequency gn by y10, instead of an amplitude spectrum value αn−1 of sound data before pitch shift for the frequency gn−1. In this case, y10 is a value obtained by multiplying x10 by the pitch shift ratio k (i.e., y10=k·x10) where y10 is larger than x10.

The pitch shifting section 13 thus gradually increases frequency x10 from the second frequency gn to perform pitch shifting on amplitude spectra before pitch shift sequentially. As a consequence, when the frequency of an amplitude spectrum as the object of pitch shifting becomes smaller than a given frequency gn−2, the frequency difference x10 from the second frequency gn becomes larger than x20. The x20 is a value which becomes y2 when multiplied by the pitch shift ratio k (x20·k=y2). For the region in which the frequency difference x1 from the second frequency gn is larger than x20 and smaller than y2 (i.e. for frequencies from gc to gn−2), the pitch shifting section 13 sets the amplitude spectra after pitch shift to αC which is an amplitude spectrum value for the middle frequency gc before pitch shift.

As described above, pitch shifting is performed by expansion between the peak spectrum P1 and the peak spectrum P2 adjacent to the peak spectrum P1. In this case, the maximum frequency f1max of the first frequency region A1 is the frequency g3 and the minimum frequency f2min of the second frequency region A2 is the frequency gn−2. Generally, there are two or more peak spectra in actual sound data. Hence, the pitch shifting section 13 performs the pitch shifting described above for two peaks adjacent to each other.

Accordingly, as described in the summary of the pitch shifting processes, the spectrum distribution AM1 adjacent to the peak spectrum P1 turns into a spectrum distribution AM10 while the shape of the spectrum distribution AM1remains unchanged and only the pitch is altered. Similarly, the spectrum distribution AM2 adjacent to the peak spectrum P2 turns into a spectrum distribution AM20 while the shape of the spectrum distribution AM20 remains unchanged and only the pitch is altered. For the amplitude spectra in the intermediate frequency region (f1max to f2min), the pitch is eventually altered at a pitch shift ratio pk. More specifically, the amplitude spectrum for frequency fa turns into an amplitude spectrum for a frequency obtained by multiplying the frequency fa by the pitch shift ratio pk(fa) which is a function of the frequency fa. Hence, the characteristics of the input sound are retained and amplitude spectra exist between the spectrum distributions AM10 after pitch shift and AM20 after pitch shift. Thus, the pitch-shifted sound data that do not contain data which generates unnatural sound is generated.

2. Compression of Input Sound Data

Next, in the case of pitch shifting for compression of input sound data, the pitch shifting section 13 shifts the first peak spectrum P1 for the first frequency g1 as it is so that it becomes the spectrum (peak spectrum P10) for the first frequency h1 after pitch shift, as shown in FIG. 5. As mentioned previously, h1=k·g1 where k is smaller than 1.

Next, the pitch shifting section 13 adopts, as the amplitude spectrum for the frequency after pitch shift h2 (=k·g2) corresponding to the frequency g2 which is larger than the first frequency g1 by x1, an amplitude spectrum value γ2 of sound data before pitch shift corresponding to the frequency g2' larger than the first frequency g1 by y1, instead of an amplitude spectrum value α2 of sound data before pitch shift for the frequency g2. In this case, y1 is a value obtained by multiplying x1 by the pitch shift ratio k (i.e. y1=k·x1) where y1 is smaller than x1.

The pitch shifting section 13 gradually increases frequency x1 from the first frequency g1 to perform pitch shifting on amplitude spectra before pitch shift sequentially. As a consequence, the frequency difference x1 from the first frequency g1 becomes equal to the difference xc between the first frequency g1 and the middle frequency gc. In this case as well, as in the above case, the pitch shifting section 13 adopts, as the amplitude spectrum for the frequency after pitch shift hc (=k·gc) corresponding to the frequency gc, an amplitude spectrum value γC1 of sound data before pitch shift for the frequency g4 larger than the first frequency g1 by yc (=k·xc), instead of an amplitude spectrum value αC of sound data before pitch shift for the frequency gc.

Similarly, the pitch shifting section 13 shifts the second peak spectrum P2 for the second frequency gn as it is so that it becomes the spectrum (peak spectrum P20) for the second frequency after pitch shift hn. As mentioned previously, hn=k·gn.

Next, the pitch shifting section 13 adopts, as the amplitude spectrum for the frequency after pitch shift hn−1 (=k·(gn−1)) corresponding to the frequency gn−1 smaller than the second frequency gn by x10, an amplitude spectrum value γn−1 of sound data before pitch shift corresponding to a frequency gn−1' smaller than the second frequency gn by y10, instead of an amplitude spectrum value αn−1 of sound data before pitch shift for the frequency gn−1. In this case, y10 is a value obtained by multiplying x10 by the pitch shift ratio k (i.e., y10=k·x10) where y10 is smaller than x10.

The pitch shifting section 13 gradually increases frequency x10 from the second frequency gn to perform pitch shifting on amplitude spectra before pitch shift sequentially. As a consequence, the frequency difference x10 from the second frequency gn becomes equal to the difference xc. In this case as well, as in the above case, the pitch shifting section 13 adopts, as the amplitude spectrum for the frequency after pitch shift hc (=k·gc) corresponding to the frequency gc, an amplitude spectrum value γC2 of sound data before pitch shift for the frequency gn−3 smaller than the second frequency gn by y1c (=k·xc), instead of an amplitude spectrum value αC of sound data before pitch shift for the frequency gc.

As described above, pitch shifting is performed by compression between the peak spectrum P1 and the peak spectrum P2 adjacent to the peak spectrum P1. In this case, the maximum frequency f1max of the first frequency region A1 and the minimum frequency f2min of the second frequency region A2 are both the frequency gc. There are two or more peak spectra in actual sound data. Hence, the pitch shifting section 13 performs the pitch shifting described above for two peaks adjacent to each other.

Accordingly, as described in the summary of the pitch shifting process, the spectrum distribution AM1 adjacent to the peak spectrum P1 turns into a spectrum distribution AM10 while the shape of the spectrum distribution AM1remains unchanged and only the pitch is altered. Similarly, the spectrum distribution AM2 adjacent to the peak spectrum P2 turns into a spectrum distribution AM20 while the shape of the spectrum distribution AM2 remains unchanged and only the pitch is altered. Thus, the pitch-shifted sound data that keeps the characteristics of the input sound and do not contain data which generates unnatural sound is generated. The description above is an actual operation of the pitch shifting section 13 to carry out the pitch shifting processes.

The pitch shifting apparatus according to the embodiment of the present invention has been described so far. According to this pitch shifting apparatus, it is possible to obtain data which can produce natural pitch-shifted sound while retaining the characteristics of the input sound. It should be noted that the present invention is not limited to the above embodiment but may be embodied in other various forms within the scope of the invention.

Figure 6:
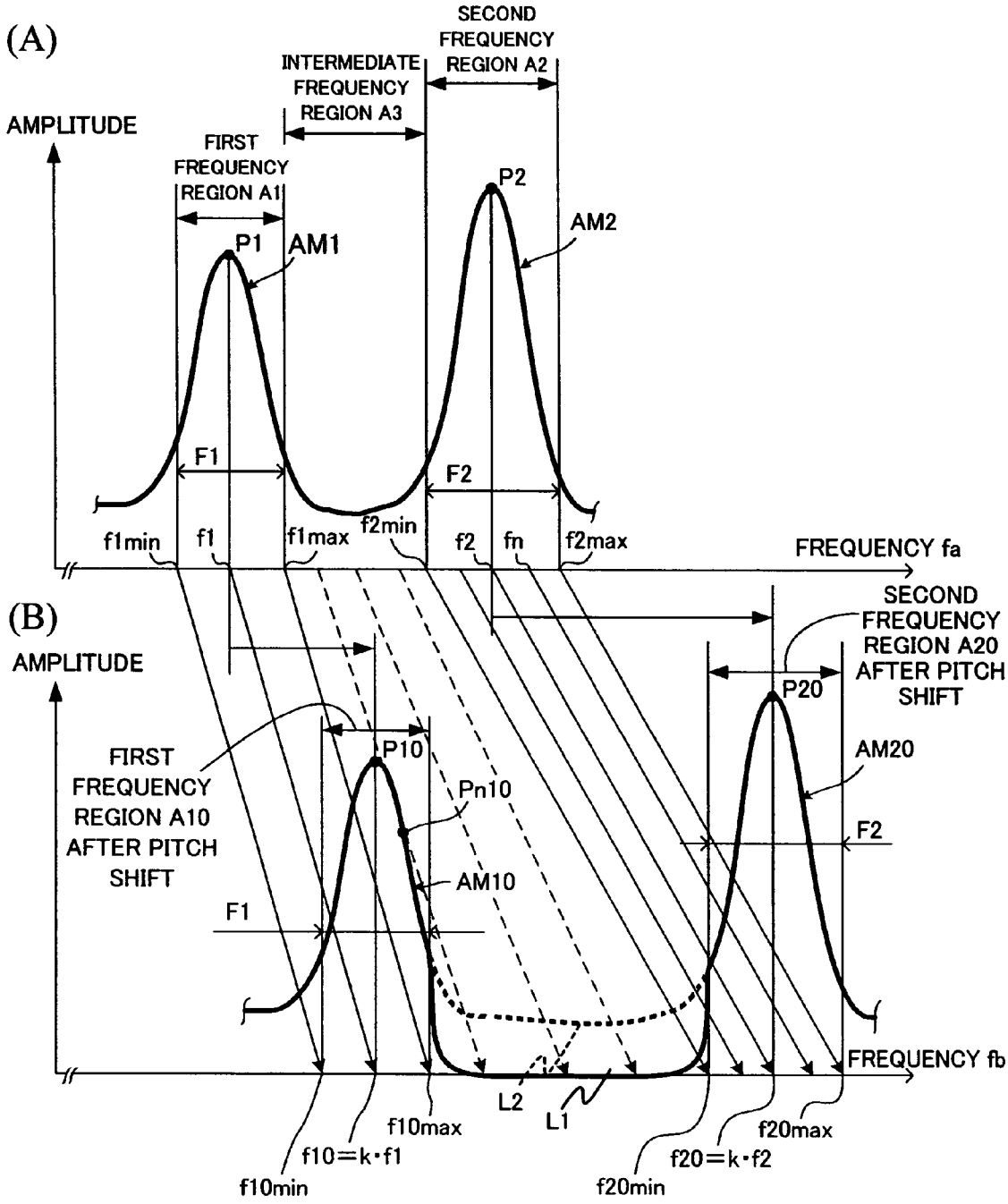
FIG. 6 is a graph illustrating a modification example of the pitch shifting method by the pitch shifting apparatus shown in FIG. 1.

For example, when the pitch shifting section 13 compresses or expands on the frequency axis each amplitude spectrum in the intermediate frequency region A3 shown in (A) of FIG. 6 so that each amplitude spectrum has a smaller value, as indicated by a solid line L1 for the intermediate frequency region after pitch shift in (B) of FIG. 6, than each amplitude spectrum on which pitch shifting has been done using the above method (as indicated by a curve shown by a dotted line L2 in (B) of FIG. 6). Namely, it obtains the final amplitude spectrum after pitch shift by multiplying the pitch-shifted amplitude spectrum by a gain smaller than 1.

Figure 7:
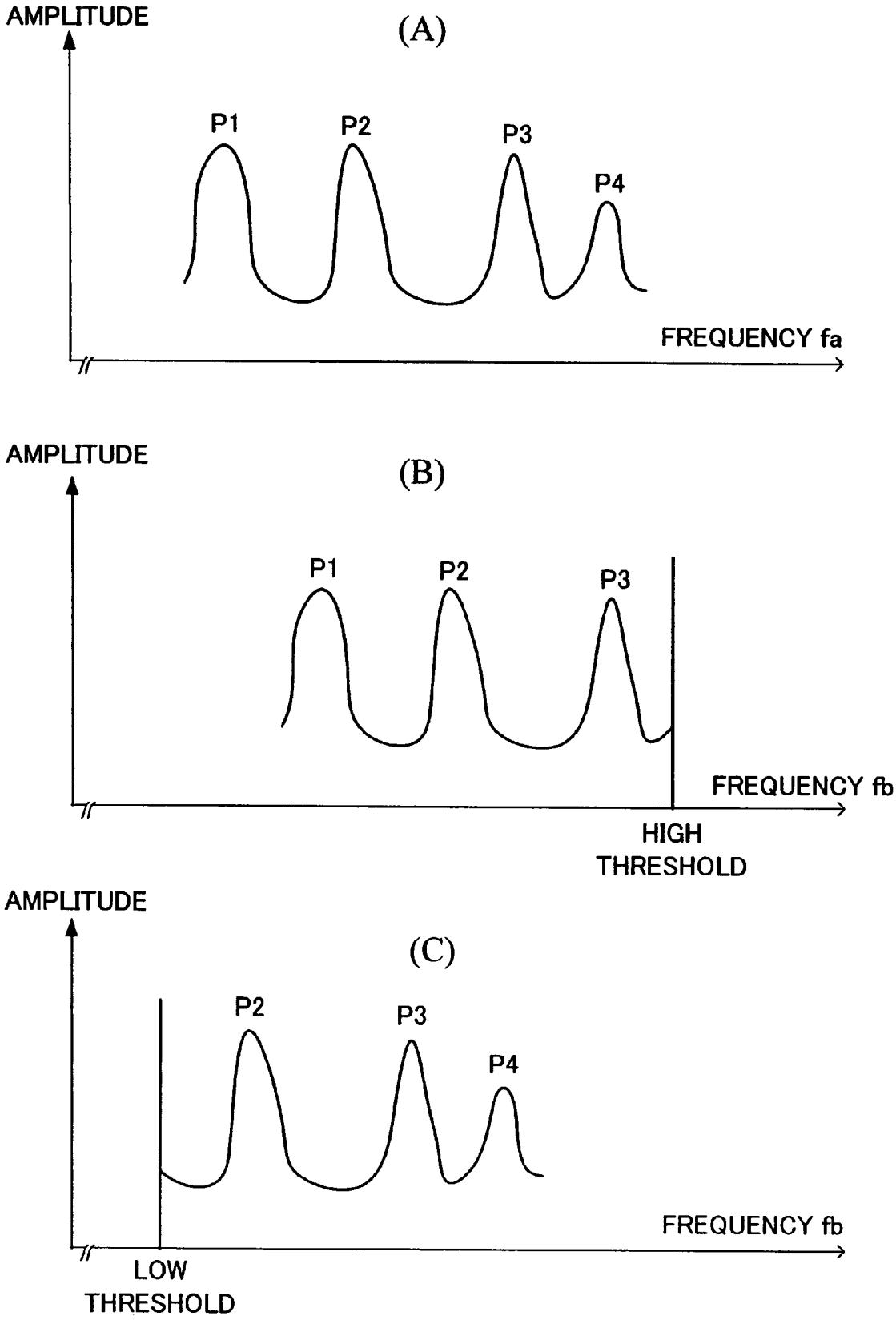
FIG. 7 includes graphs illustrating another modification example of the pitch shifting method by the pitch shifting apparatus shown in FIG. 1.

Furthermore, if an amplitude spectrum for a frequency above a given high threshold is generated as a result of pitch shifting by expanding the sound data as shown in (A) of FIG. 7 in accordance with the above method, the pitch shifting section 13 may make the amplitude spectra in the region above the high threshold substantially 0 as shown in (B) of FIG. 7. In this case, the high threshold is set to a frequency of a high tone which cannot occur in normal musical sound.

Similarly, if an amplitude spectrum for a frequency below a given low threshold is generated as a result of pitch shifting by compressing the sound data as shown in (A) of FIG. 7 in accordance with the above method, the pitch shifting section 13 may make the amplitude spectra in the region below the low threshold substantially 0 as shown in (C) of FIG. 7. In this case, the low threshold is set to the frequency of a low tone which cannot occur in normal musical sound.

By means of the modification described above, even when an amplitude spectrum for a high frequency or a low frequency which cannot occur in a normal musical performance should occur by the amplitude spectrum compression or expansion on the frequency axis, the amplitude spectrum for such a frequency is removed. As a result, sound data which can produce good quality sound can be generated.

It is also possible that the pitch shifting section 13 prepares an envelope curve for each peak spectrum before pitch shift in advance and if a spectrum distribution after pitch shift by amplitude spectrum compression or expansion has an amplitude spectrum larger than the prepared envelope curve, it may modify the amplitude spectra (the spectrum distribution) after pitch shift so as to fit the amplitude spectrum to the envelope curve. This operation can retain the characteristics of the input sound more precisely.

Furthermore, one possible method of identifying (specifying) the first frequency region A1 and the second frequency region A2 is that the frequency axis between two adjacent local peaks (the first peak spectrum P1 and the second peak spectrum P2) is halved and each half is allocated to a region including the nearer local peak, and another possible method is that a trough which is a point having the smallest amplitude value between the two adjacent local peaks is detected and a frequency corresponding to the smallest amplitude value is taken as the boundary between the adjacent regions.

Generally, sound data transformed into a frequency domain representation includes many amplitude spectrum local peaks (peak spectra). If that is the case, the frequency domain may divided into plural regions each including N peak spectra (N being plural number; for example, 2 or 3) and the pitch shifting method according to the present invention may then be applied to spectra in each region.

Specifically, for example, when the pitch is increased by expansion and if plural peak spectra correspond to frequencies f0, f1, f2, f3, f4, f5 and f6 (f0<f1<f2<f3<f4<f5<f6), the value of N above is set to 3. Then, the frequency domain is divided into a frequency region including three (N) frequencies f0, f1 and f2 (low frequency region) and a frequency region including three (N) frequencies f4, f5 and f6 (high frequency region).

Thereafter, by applying the present invention to each region (each section), it is possible to obtain spectra for the frequency region after pitch shift corresponding to the low frequency region (spectra having peak spectra at f0' for f0, f1' for f1, and f2' for f2, respectively) and also obtain spectra for the frequency region after pitch shift corresponding to the high frequency region (spectra having peak spectra at f4' for f4, f5' for f5, and f6' for f6, respectively).

Further, for example, in the above case, when the pitch is decreased by compression, the frequency domain is divided into a frequency region including three (N) frequencies f0, f1 and f2 (first section), a frequency region including three (N) frequencies f2, f3 and f4 (second section) and a frequency region including three (N) frequencies f4, f5 and f6 (third section).

Then, by applying the present invention to each region, it is possible to obtain spectra for the frequency region after pitch shift corresponding to the first section (spectra having peak spectra at f0' for f0, f1' for f1, and f2' for f2, respectively) and obtain spectra for the frequency region after pitch shift corresponding to the second section (spectra having peak spectra at f2' for f2, f3' for f3, and f4' for f4, respectively), and also obtain spectra for the frequency region after pitch shift corresponding to the third section (spectra having peak spectra at f4' for f4, f5' for f5, and f6' for f6, respectively). However, when this process is carried out, an overlap zone or uncovered zone may be generated on the frequency axis as each region is compressed or expanded. Thus, an appropriate method for these zones may be used so as to obtain spectra which produce less unnatural sound.

The invention claimed is:

1. A pitch shifting method, comprising:

a step of transforming input time domain representation sound data into frequency domain representation sound data;

a step of generating pitch-shifted sound data by compressing or expanding amplitude spectra of the transformed frequency domain representation sound data on a frequency axis;

a step of transforming the pitch-shifted sound data from the frequency domain representation sound data into time domain representation sound data; and a step of outputting the transformed time domain representation sound data;

wherein the step of generating pitch-shifted sound data, including, a step of selecting, among the amplitude spectra of the transformed frequency domain representation sound data, at least two peak spectra that are a first peak spectrum and a second peak spectrum having a second frequency higher than a first frequency which is a frequency for the first peak spectrum;

a step of shifting the first peak spectrum on the frequency axis so that the first peak spectrum becomes an amplitude spectrum for a pitch-shifted first frequency which is a frequency obtained by multiplying the first frequency by a given pitch shift ratio k;

a step of compressing or expanding, on the frequency axis, each of amplitude spectra in a first frequency region which is a given frequency region including the first frequency so that each of the amplitude spectra in the first frequency region becomes an amplitude spectrum for a frequency obtained by adding a value which is obtained by multiplying a result of subtraction of the first frequency from a frequency for the each amplitude spectrum by a local shift ratio m closer to 1 than the pitch shift ratio k, to the pitch-shifted first frequency;

a step of shifting the second peak spectrum on the frequency axis so that the second peak spectrum becomes an amplitude spectrum for a pitch-shifted second frequency which is a frequency obtained by multiplying the second frequency by the given pitch shift ratio k;

a step of compressing or expanding, on the frequency axis, each of amplitude spectra in a second frequency region which is a given frequency region including the second frequency so that each of the amplitude spectra in the second frequency region becomes an amplitude spectrum for a frequency obtained by adding a value which is obtained by multiplying a result of subtraction of the second frequency from a frequency for the each amplitude spectrum by the local shift ratio m, to the pitch-shifted second frequency; and a step of compressing or expanding, on the frequency axis, each of amplitude spectra in an intermediate frequency region between the first frequency region and the second frequency region so that each of the amplitude spectra in the intermediate frequency region becomes an amplitude spectrum for a frequency obtained by multiplying a frequency for the each amplitude spectrum by each pitch shift ratio depending on the each amplitude spectrum.

2. A pitch shifting apparatus, comprising:

time-frequency transformation means for transforming input time domain representation sound data into frequency domain representation sound data;

pitch shifting means for generating pitch-shifted sound data by compressing or expanding amplitude spectra of the transformed frequency domain representation sound data on a frequency axis;

frequency-time transformation means for transforming the pitch-shifted sound data from frequency domain representation sound data into time domain representation sound data; and output means for outputting the transformed time domain representation sound data;

wherein said pitch shifting means is configured to select, based on amplitude spectra of the transformed frequency domain representation sound data, at least one amplitude spectrum which expresses characteristics of the sound data as a selected amplitude spectrum, shift the selected amplitude spectrum on the frequency axis so that the selected amplitude spectrum becomes an amplitude spectrum for a pitch-shifted selected frequency which is a frequency obtained by multiplying a selected frequency which is a frequency for the selected amplitude spectrum by a given pitch shift ratio k, compress or expand, on the frequency axis, each of amplitude spectra in a selected frequency region which is a given frequency region including the selected frequency so that each of the amplitude spectra in the selected frequency region becomes an amplitude spectrum for a frequency obtained by adding a value which is obtained by multiplying a result of subtraction of the selected frequency from a frequency for the each amplitude spectrum by a local shift ratio m closer to 1 than the pitch shift ratio k, to the pitch-shifted selected frequency; and compress or expand, on the frequency axis, each of amplitude spectra outside the selected frequency region so that each of the amplitude spectra outside the selected frequency region becomes an amplitude spectrum for a frequency obtained by multiplying a frequency for the each amplitude spectrum by each pitch shift ratio depending on the each amplitude spectrum.

3. The pitch shifting apparatus according to claim 2, wherein the pitch shifting means is configured to make amplitude spectra in a region in which a frequency after the compression or the expansion is above a given high threshold, substantially 0.

4. The pitch shifting apparatus according to claim 2, wherein the pitch shifting means is configured to make amplitude spectra in a region in which a frequency after the compression or the expansion is below a given low threshold, substantially 0.

5. A pitch shifting apparatus, comprising:

time-frequency transformation means for transforming input time domain representation sound data into frequency domain representation sound data;

pitch shifting means for generating pitch-shifted sound data by compressing or expanding amplitude spectra of the transformed frequency domain representation sound data on a frequency axis;

frequency-time transformation means for transforming the pitch-shifted sound data from the frequency domain representation sound data into time domain representation sound data; and output means for outputting the transformed time domain representation sound data;

wherein the pitch shifting means is configured to select, among the amplitude spectra of the transformed frequency domain representation sound data, at least two peak spectra that are a first peak spectrum and a second peak spectrum having a second frequency higher than a first frequency which is a frequency for the first peak spectrum;

shift the first peak spectrum on the frequency axis so that the first peak spectrum becomes an amplitude spectrum for a pitch-shifted first frequency which is a frequency obtained by multiplying the first frequency by a given pitch shift ratio k;

compress or expand, on the frequency axis, each of amplitude spectra in a first frequency region which is a given frequency region including the first frequency so that each of the amplitude spectra in the first frequency region becomes an amplitude spectrum for a frequency obtained by adding a value which is obtained by multiplying a result of subtraction of the first frequency from a frequency for the each amplitude spectrum by a local shift ratio m closer to 1 than the pitch shift ratio k, to the pitch-shifted first frequency;

shift the second peak spectrum on the frequency axis so that the second peak spectrum becomes an amplitude spectrum for a pitch-shifted second frequency which is a frequency obtained by multiplying the second frequency by the given pitch shift ratio k;

compress or expand, on the frequency axis, each of amplitude spectra in a second frequency region which is a given frequency region including the second frequency so that each of the amplitude spectra in the second frequency region becomes an amplitude spectrum for a frequency obtained by adding a value which is obtained by multiplying a result of subtraction of the second frequency from a frequency for the each amplitude spectrum by the local shift ratio m, to the pitch-shifted second frequency; and compress or expand, on the frequency axis, each of amplitude spectra in an intermediate frequency region between the first frequency region and the second frequency region so that each of the amplitude spectra in the intermediate frequency region becomes an amplitude spectrum for a frequency obtained by multiplying a frequency for the each amplitude spectrum by each pitch shift ratio depending on the each amplitude spectrum.

6. The pitch shifting apparatus according to claim 5, wherein the pitch shifting means is configured to, assuming a graph where a horizontal axis or X axis represents frequency before pitch shift and a vertical axis or Y axis represents frequency after pitch shift, and also assuming that k denotes the given pitch shift ratio, m denotes the local shift ratio, a1 and a2 denote given constants, f1 denotes the first frequency, f2 denotes the second frequency, f1max denotes maximum frequency of the first frequency region and f2min denotes minimum frequency of the second frequency region, compress or expand each amplitude spectrum in the first frequency region on the frequency axis in accordance with function $Y=m\cdot X+a1$;

compress or expand each amplitude spectrum in the second frequency region on the frequency axis in accordance with function $Y=m\cdot X+a2$;

where k satisfies a relation of $k=((m\cdot f2+a2)-(m\cdot f1+a1))/(f2-f1)$; and further, compress or expand each amplitude spectrum in the intermediate frequency region on the frequency axis in accordance with a given function $Y=Tf(X)$ connecting a point (f1max, f1max+a1) with a point (f2min, f2min+a2) in the intermediate frequency region.

7. The pitch shifting apparatus according to claim 5, wherein the pitch shifting means is configured to, when compressing or expanding each amplitude spectrum in the intermediate frequency region on the frequency axis, make the each amplitude spectrum a value smaller than the each amplitude spectrum prior to the compression or the expansion.

8. The pitch shifting apparatus according to claim 6, wherein the pitch shifting means is configured to, when compressing or expanding each amplitude spectrum in the intermediate frequency region on the frequency axis, make the each amplitude spectrum a value smaller than the each amplitude spectrum prior to the compression or the expansion.

9. The pitch shifting apparatus according to claim 6, wherein the pitch shifting means is configured to make amplitude spectra in a region in which a frequency after the compression or the expansion is above a given high threshold, substantially 0.

10. The pitch shifting apparatus according to claim 7, wherein the pitch shifting means is configured to make amplitude spectra in a region in which a frequency after the compression or the expansion is above a given high threshold, substantially 0.

11. The pitch shifting apparatus according to claim 8, wherein the pitch shifting means is configured to make amplitude spectra in a region in which a frequency after the compression or the expansion is above a given high threshold, substantially 0.

12. The pitch shifting apparatus according to claim 5, wherein the pitch shifting means is configured to make amplitude spectra in a region in which a frequency after the compression or the expansion is above a given high threshold, substantially 0.

13. The pitch shifting apparatus according to claim 5, wherein the pitch shifting means is configured to make amplitude spectra in a region in which a frequency after the compression or the expansion is below a given low threshold, substantially 0.

14. The pitch shifting apparatus according to claim 6, wherein the pitch shifting means is configured to make amplitude spectra in a region in which a frequency after the compression or the expansion is below a given low threshold, substantially 0.

15. The pitch shifting apparatus according to claim 7, wherein the pitch shifting means is configured to make amplitude spectra in a region in which a frequency after the compression or the expansion is below a given low threshold, substantially 0.

16. The pitch shifting apparatus according to claim 8, wherein the pitch shifting means is configured to make amplitude spectra in a region in which a frequency after the compression or the expansion is below a given low threshold, substantially 0.

17. A pitch shifting method, comprising:

a step of transforming input time domain representation sound data into frequency domain representation sound data;

a step of generating pitch-shifted sound data by compressing or expanding amplitude spectra of the transformed frequency domain representation sound data on a frequency axis;

a step of transforming the pitch-shifted sound data from frequency domain representation sound data into time domain representation sound data; and a step of outputting the transformed time domain representation sound data;

wherein the step of generating pitch-shifted sound data, including, a step of selecting, based on amplitude spectra of the transformed frequency domain representation sound data, at least one amplitude spectrum which expresses characteristics of the sound data as a selected amplitude spectrum, a step of shifting the selected amplitude spectrum on the frequency axis so that the selected amplitude spectrum becomes an amplitude spectrum for a pitch-shifted selected frequency which is a frequency obtained by multiplying a selected frequency which is a frequency for the selected amplitude spectrum by a given pitch shift ratio k, a step of compressing or expanding, on the frequency axis, each of amplitude spectra in a selected frequency region which is a given frequency region including the selected frequency so that each of the amplitude spectra in the selected frequency region becomes an amplitude spectrum for a frequency obtained by adding a value which is obtained by multiplying a result of subtraction of the selected frequency from a frequency for the each amplitude spectrum by a local shift ratio m closer to 1 than the pitch shift ratio k, to the pitch-shifted selected frequency; and a step of compressing or expanding, on the frequency axis, each of amplitude spectra outside the selected frequency region so that each of the amplitude spectra outside the selected frequency region becomes an amplitude spectrum for a frequency obtained by multiplying a frequency for the each amplitude spectrum by each pitch shift ratio depending on the each amplitude spectrum.

* * * * *